United States Patent [19]

Hafner

[11] 4,253,177

[45] Feb. 24, 1981

[54] APPARATUS FOR MANUAL ADJUSTMENT OF A CLOCK

[75] Inventor: Dieter Hafner, Nurnberg, Fed. Rep. of Germany

[73] Assignee: Diehl GmbH & Co., Nurnberg, Fed. Rep. of Germany

[21] Appl. No.: 102,250

[22] Filed: Dec. 10, 1979

[30] Foreign Application Priority Data

Dec. 14, 1978 [DE] Fed. Rep. of Germany ..... 2853911

[51] Int. Cl.[3] ..... G04C 9/08; G04G 5/00; G04G 5/02

[52] U.S. Cl. ..... 368/187; 368/188; 368/294

[58] Field of Search ..... 58/23 R, 23 D, 85.5, 58/91; 368/187, 188, 294

[56] References Cited

U.S. PATENT DOCUMENTS

| | | | |
|---|---|---|---|
| 1,410,050 | 3/1922 | Wyss | 58/46 W |
| 4,040,248 | 8/1977 | Laesser | 58/19 A |

FOREIGN PATENT DOCUMENTS

| | | | |
|---|---|---|---|
| 2111209 | 1/1971 | Fed. Rep. of Germany . | |
| 2249588 | 4/1974 | Fed. Rep. of Germany . | |
| 2658105 | 6/1976 | Fed. Rep. of Germany . | |
| 2501973 | 7/1976 | Fed. Rep. of Germany | 58/85.5 |
| 69989 | 9/1915 | Switzerland . | |
| 259511 | 1/1949 | Switzerland . | |

*Primary Examiner*—Edith S. Jackmon

*Attorney, Agent, or Firm*—Burns, Doane, Swecker & Mathis

[57] ABSTRACT

An actuating element for the manual adjustment of a clock comprises a rotating collar face which is arranged around the time indicating device of the clock. In a mechanical or electromechanical clock, the rotating movement of the rotating collar face is transmitted through gearing to the dial train of the clock. In an electronic clock pulse-producing elements are arranged on the collar and pulse-receiving elements are fixed in the clock to produce individual pulses or pulse trains which can be counted in according to the backward counting input of the time storage which is in operative connection with the indicating element of the clock.

9 Claims, 4 Drawing Figures

APPARATUS FOR MANUAL ADJUSTMENT OF A CLOCK

BACKGROUND AND OBJECTS OF THE INVENTION

The invention concerns a device for the manual adjustment of a clock, preferentially a wristwatch.

Clock adjusting devices are well known. For example, the adjustment of mechanical or electromechanical hand clocks takes place preferentially by means of a winding button attached to the side of the clock housing which is connected mechanically with an adjusting shaft which can be coupled through a gear to the dial train of the clock.

Further, a device for the adjustment of electronic clocks is well known in German DE-OS No. 26 58 105 which features pulse-generating elements for the production of digital adjusting pulses for the adjustment or correction, as the case may be, of an electronic display element of a clock and which interact with pulse-receiving elements. The pulse-generating elements are preferentially arranged around a rotating axis to which the actuating element of the device is arranged, connected and is available to the operating person. By means of such a device, individual pulses or pulse trains can be produced which, depending on the direction of rotation of the actuating element, can be counted into the forward counting input or into the backward counting input of the storage connected with the indicator of the clock.

Devices of such a type are, when they are used in very flat clocks or watches as the case may be, burdened with a number of disadvantages.

For one thing, wih a small clock, fingertip operation of the actuating element constructed as a rotating winding button is uncomfortable for the operating person. Also, a precise adjustment is oftentimes difficult to carry out with an operating element having only a few millimeters diameter. Finally, the above-described devices require relatively much space in a small and very flat casing, for example, the casing of a wristwatch.

The present invention has the object of producing a device for adjusting a clock, preferentially a wristwatch which is easily and accurately operable and is adapted to the limited space requirements of a wristwatch housing. Further, the device should be economical and mass producible.

SUMMARY OF THE INVENTION

The object is solved according to the invention in that the actuating element of the device is constructed as a rotating collar plate which is arranged around the time indicating device of the clock.

The rotating collar plate can be arranged as an actuating element on an electronic clock. Likewise, the use of the device is conceivable on a mechanical or electromechanical clock.

THE DRAWINGS

DETAILED DESCRIPTION OF A PREFERRED EMBODIMENT OF THE INVENTION

Figure 1:
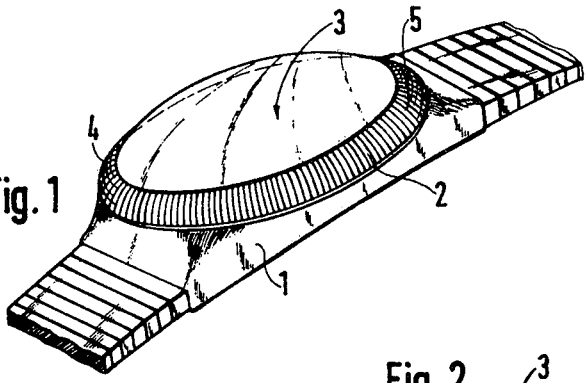
FIG. 1 is a perspective outside view of a wristwatch containing an adjusting apparatus according to the invention.

According to FIG. 1, a wristwatch featuring the device according to the invention comprises a casing 1 on which is arranged a rotating collar plate 2 around the time indicating device 3 of the clock. The time indicating device 3 of the clock can be constructed as an analog indicating element or as a digital indicating element. The external circumference 4 of the rotating collar plate 2 is provided with a straight knurling 5 which ensures a good grip for the operating person when actuating the rotating collar plate 2. It is possible by means of the rotating collar plate 2 to adjust, depending on the design of the clock, seconds, minutes, hours or even the week days of a calendar device.

Figure 2:
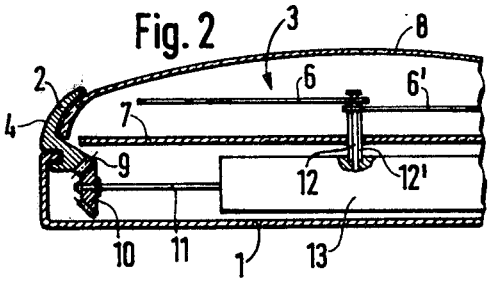
FIG. 2 is a cross sectional view of a mechanical or electromechanical type of wristwatch containing the invention.

By means of a cross section through the mechanical or electromechanical clock, FIG. 2 illustrates the collar plate 2 which is arranged on the clock casing 1 of the clock. The clock features an analog indicating device 3 which essentially comprises two hands 6, 6' and a clock face 7. The indicating device is covered by a clock glass 8.

An internal gear-tooth system 9 is arranged on the rotating collar plate 2 and which is constructed preferably as a bevel gear-tooth system and which meshes with a toothed wheel 10 which is arranged on the adjusting shaft 11 of the clock. The adjusting shaft 11 is mechanically connected through a gear train 13 with set-hand arbors 12, 12' of the clock hands 6, 6'. The gear train 13 is standard and forms a part of a mechanical or electromechanical clockwork.

If the setting of clock hands 6, 6' is to be changed, it follows that the user of the clock must turn the rotating clock face 2 in the one or the other direction. At the same time, the rotating movement of the rotating clock face 2 is transmitted through the internal gear-tooth system 9, the toothed wheel 10, the adjusting shaft 11, the gear train of the clockwork 13 as well as the set-hands arbors 12 and 12' of the hands 6, 6'.

Figure 3:
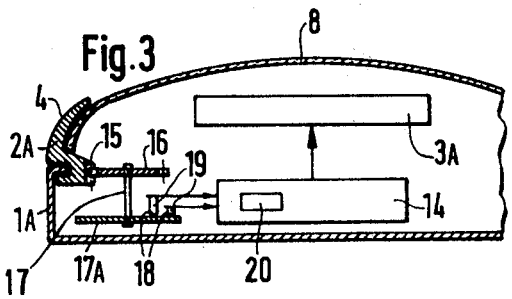
FIG. 3 is a cross sectional view through an electronic type of wristwatch containing the invention.

FIG. 3 shows a cross sectional view through a modified electronic clock which essentially comprises a clock casing 1, a rotating collar plate 2A, an indicating element 3A and a standard electronic clock circuit 14 which is connected electrically with the indicating element 3A. For protection of the indicating element 3A which, in this case, preferably comprises a standard digital display arrangement is made in the clock glass 8 inside of the rotating collar plate 2.

The collar plate 2 features a gear-tooth system 15 inside of the clock which meshes mechanically with a toothed wheel 16 arranged on a shaft 17. Two sets of pulse-generating elements 18 are arranged in circular patterns around the shaft 17 on a disc 17A connected to the latter. The elements 18 interact with pulse-receiving elements 19. By means of the pulse-generating elements 18 which, for example, can be constructed as contact strips and the pulse-receiving elements 19, for example constructed as contact springs, individual pulses or pulse trains can be generated which, depending on the direction of rotation of the rotating clock face 2A, can be counted into the forward counting input or the backward counting input of a forward-backward counter 20 located in the electrical clock circuit 14. If the time indicated on the digital display device 3A of this clock is to be adjusted forward or backward, it follows that the operating person must turn the rotating clock face 2A in the one or the other direction. Accordingly, the pulse-generating elements 18 are moved on a circular path on the pulse-receiving elements 19 and generate single or a number of adjusting pulses which can modify the content of the foward-backward counter 20 forward or backward.

Figure 4:
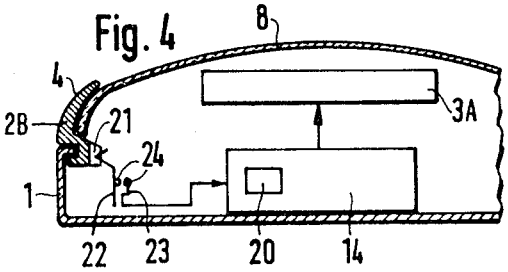
FIG. 4 is a cross sectional view through an electronic type of wristwatch having a modified form of adjusting apparatus according to the invention.

The form of construction of the device according to the invention shown in FIG. 4 is differentiated from the device shown in FIG. 3 only by the arrangement of the pulse-generating and pulse-receiving elements.

In this case, the pule-generating elements comprise cams 21 arranged directly on the inside of the rotating collar plate 2B. These cams 21 interact mechanically with a flexible contact element 22. When twisting the rotating collar plate 2B in the one or the other direction, the flexible contact element 22 is pressed against a contact element 23 by the cam 21, whereby contact lugs 24 arranged on the two contact elements 22 and 23 touch. Accordingly, when turning collar plate 2B, there occurs opening and closing of the contact section formed by the contact 22, 23 or 24, whereby individual pulses or pulse trains are generated which, depending on the direction of rotation of collar plate 2B, can be counted in an already-mentioned manner into the forward counting input or the backward counting input of the conventional forward-backward counter 20, arranged in the clock circuit 14. The content of forward-backward counter 20 is decoded by the electronic clock circuit 14 and supplied to the indicating element 3A.

Understandably, it is also within the scope of the invention that the pulse-generating elements 18, 21 as well as the pulse-receiving elements 19, 22 interact for pulse generation with one another according to other suitable physical principles.

When the pulse-generating elements are themselves arranged directly on the inside of the rotating collar plate 2B and interact with pulse-receiving elements which are attached in the clock casing 1, it follows that the construction of the device according to the invention is carried out on an extremely cost-favorable and space-economical basis.

Although the invention has been described in connection with a preferred embodiment thereof, it will be appreciated by those skilled in the art that additions, modifications, substitutions and deletions may be made without departing from the spirit and scope of the invention as defined in the appended claims.

What is claimed is:

1. In a clock having time indicating means and adjusting means for adjusting said time indicating means, the improvement wherein said adjusting means comprises a rotating collar plate arranged around said time indicating means and operably connecting said collar plate with said time indicating means, said adjusting means further comprising pulse generating means connected to said rotating collar plate, a counter having forward and backward counting inputs and connected to said time indicating means, and pulse receiving means connected to said counting inputs and interacting with said pulse generating means for generating pulses that are counted into the forward counting input or the backward counting input depending upon the direction of rotation of said collar plate.

2. Apparatus according to claim 1, wherein said collar plate includes internal gear teeth, a toothed wheel mounted in meshing engagement with said teeth and connected to said pulse generating means.

3. Apparatus according to claim 1, wherein said pulse generating means being mounted directly on said collar plate.

4. Apparatus according to claim 3, wherein said pulse generating means being defined by a plurality of cams on an inside surface of said collar plate.

5. Apparatus according to claim 1, wherein said pulse generating means being capable of producing at least two out-of-phase, overlapping pulses.

6. Apparatus according to claim 1, wherein said clock comprises a wristwatch.

7. Apparatus according to claim 1, wherein said clock includes a transparent cover overlying said time indicating means, said collar plate means comprising an annular ring surrounding said cover.

8. Apparatus according to claim 4 wherein said pulse generating means comprises a pair of contact strips mounted on a disc, said disc being rotatably connected to said toothed wheel.

9. Apparatus according to claim 6 wherein said pulse receiving means comprises a flexible contact engaged by said cams to repeatedly contact a fixed contact.

* * * * *